US005556145A

United States Patent [19]

Takasaki

[11] Patent Number: 5,556,145

[45] Date of Patent: Sep. 17, 1996

[54] PUSH BUTTON-OPERATED FLUSH TYPE HANDLE ASSEMBLY

[75] Inventor: Kunihiko Takasaki, Tokyo, Japan

[73] Assignee: Takigen Manufacturing Co. Ltd., Tokyo, Japan

[21] Appl. No.: 500,345

[22] Filed: Jul. 10, 1995

[30] Foreign Application Priority Data

Aug. 12, 1994 [JP] Japan ..... 6-212127

[51] Int. Cl.[6] ..... E05B 3/00

[52] U.S. Cl. ..... 292/336.3; 292/DIG. 31; 292/DIG. 37; 292/DIG. 65; 70/208

[58] Field of Search ..... 292/336.3, DIG. 31, 292/DIG. 37, DIG. 65; 70/208, 360, 361

[56] References Cited

U.S. PATENT DOCUMENTS 1,558,980 10/1925 Halinka ..... 292/DIG. 31 X
2,253,547 8/1941 Adams ..... 70/208
2,461,393 2/1949 Paxton ..... 292/DIG. 31 X
2,486,586 11/1949 Brittain et al. ..... 70/208 X
3,044,815 7/1962 Soss ..... 70/208 X
5,457,971 10/1995 Yamada ..... 292/DIG. 31 X

*Primary Examiner*—Rodney M. Lindsey
*Attorney, Agent, or Firm*—Martin Smolowitz

[57] ABSTRACT

A push-button-operated flush type handle assembly is provided. The assembly enables a person trapped in a cabinet to unlock and open a cabinet door from inside even when push button 16 is locked from outside. In the assembly: handle 4 is pivoted to housing 2 of casing 1 and swingably urged by spring 20 in its projecting direction; projection 7 for rotatably driving lock plate 6 is formed in the handle; latch 29 is mounted in guide hole 3 of the casing and slidably urged by spring 22 toward pivot 5; locking projection 12 engaged with and disengaged from receiver projection 11 of the handle is formed in the latch; oblique cam surface 19 is formed in the latch which has operating projection 14 in its rear surface; escape hole 15 of bottom wall of the casing permits the projection 14 to pass therethrough; and, oblique cam surface 18 is formed in the push button or in push-button guide 17 fitted to the push button.

4 Claims, 5 Drawing Sheets

FIG.4
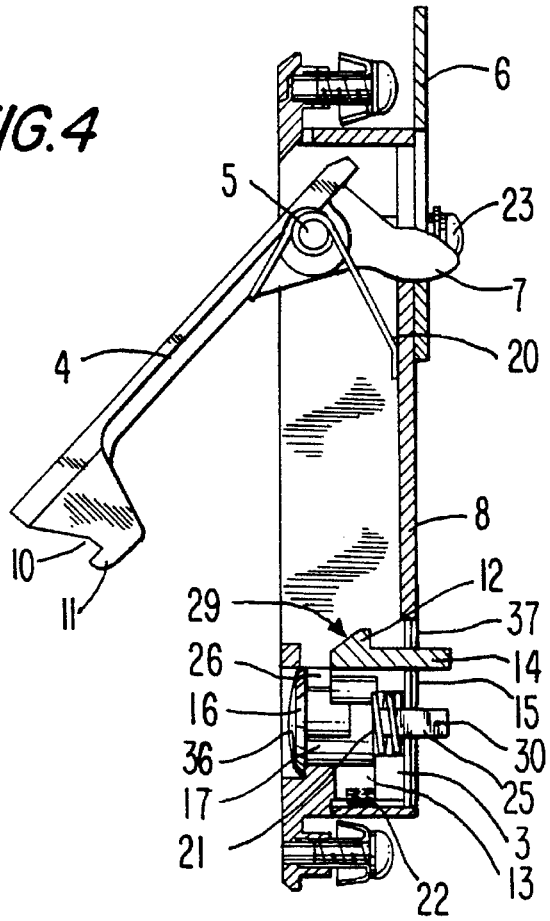
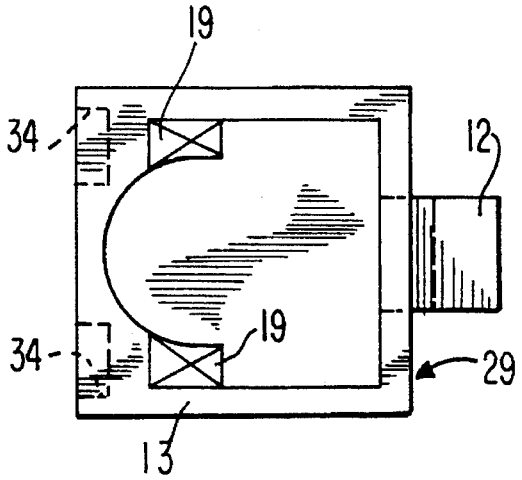
FIG.5
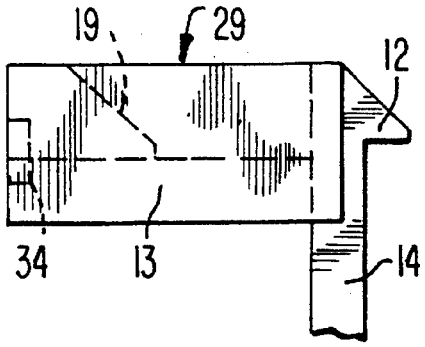
FIG.6

PUSH BUTTON-OPERATED FLUSH TYPE HANDLE ASSEMBLY

BACKGROUND OF THE INVENTION

1. Field of the Invention

The present invention relates to a push button-operated flush type handle assembly employed in a plugboard cabinet and the like.

2. Description of the Prior Art

In a conventional push button-operated flush type handle assembly, a casing is provided with a concave housing and a guide hole adjacent to the concave housing; a handle body is pivotally mounted in the concave housing through a cross pivot, and swingably urged by a spring in its projecting direction; a push button is mounted in the guide hole; a latch element mounted in a rear portion of the guide hole is slidably urged by a spring toward the concave housing; a locking projection, which is engaged with and disengaged from a receiver projection of a front end of the handle body, is provided in a front end of the latch element; and, a roller, which is brought into contact with an oblique cam surface of the push button, is mounted on the latch element.

In this conventional assembly, when the push button is depressed by a predetermined depth from outside the door, the latch element is slidably moved rearward until the locking projection is disengaged from the receiver projection of the handle body, so that the handle body is released and swingably projected under the influence of a resilient force exerted by the spring, whereby the operating projection of the rear side of the handle body rotatably moves the lock plate to its unlocking position. However, in the conventional assembly, since there is not provided any means for operating the push button and the latch element from inside the door at all, it is not possible for a person, who is trapped in the cabinet while he checks cabinet installations, to escape from the cabinet by himself.

SUMMARY OF THE INVENTION

Consequently, it is an object of the present invention to provide a push button-operated flush type handle assembly which enables a person trapped in a cabinet to unlock and open a door of the cabinet from inside the door, even when a push button of the assembly is locked from outside the door.

The above object of the present invention is accomplished by providing:

A push button-operated flush type handle assembly characterized in that:

a casing is provided with a concave housing and a guide hole adjacent to the concave housing;

a projectable and retractable handle body is pivotally mounted in the concave housing through a cross pivot, and swingably urged by a first spring in its projecting direction;

the handle body is further provided with an first operating projection which projects rearward from a rear side of the handle body and rotatably drives a lock plate;

a first escape hole is provided in a bottom wall of the casing to permit the first operating projection to pass therethrough;

a push button is mounted in the guide hole in an insertion manner;

a latch element fitted to the push button is also mounted in the guide hole in an insertion manner;

the latch element is slidably urged toward the cross pivot by a second spring;

a locking projection, which is engaged with and disengaged from a receiver projection of the handle body, is provided in a front end of the latch element;

the latch element is provided with a second operating projection in its rear side to have the second operating projection project rearward from the rear side;

a first escape hole is provided in the bottom wall of the casing to permit the second operating projection to pass therethrough; and a first oblique cam surface, which abuts on a second oblique cam surface of the latch element, is provided in the push button itself or in a push-button guide fitted to the push button.

BRIEF DESCRIPTION OF THE DRAWINGS

FIG. 4 is a longitudinal sectional side view of the flush type handle assembly of the present invention shown in FIG. 1, illustrating the projected handle body;

FIG. 5 is a plan view of the latch element incorporated in the flush type handle assembly of the present invention shown in FIG. 1;

FIG. 6 is a side view of the latch element shown in FIG. 5;

DESCRIPTION OF THE PREFERRED EMBODIMENTS

Figure 1:
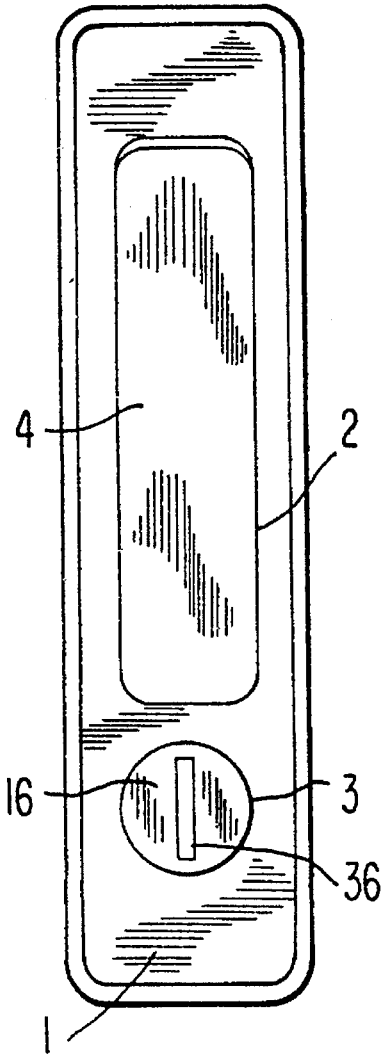
FIG. 1 is a front view of an embodiment of the push button-operated flush type handle assembly of the present invention.
Figure 3:
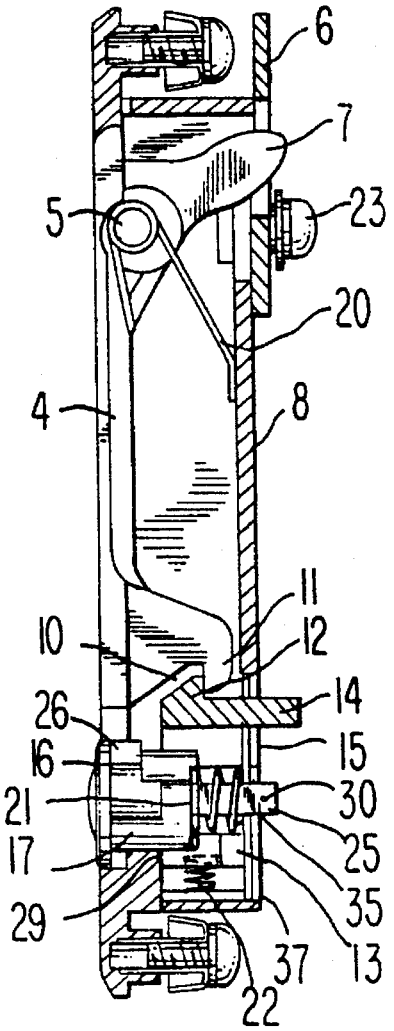
FIG. 3 is a longitudinal sectional side view of the flush type handle assembly of the present invention shown in FIG. 1, illustrating the retracted handle body.
Figure 2:
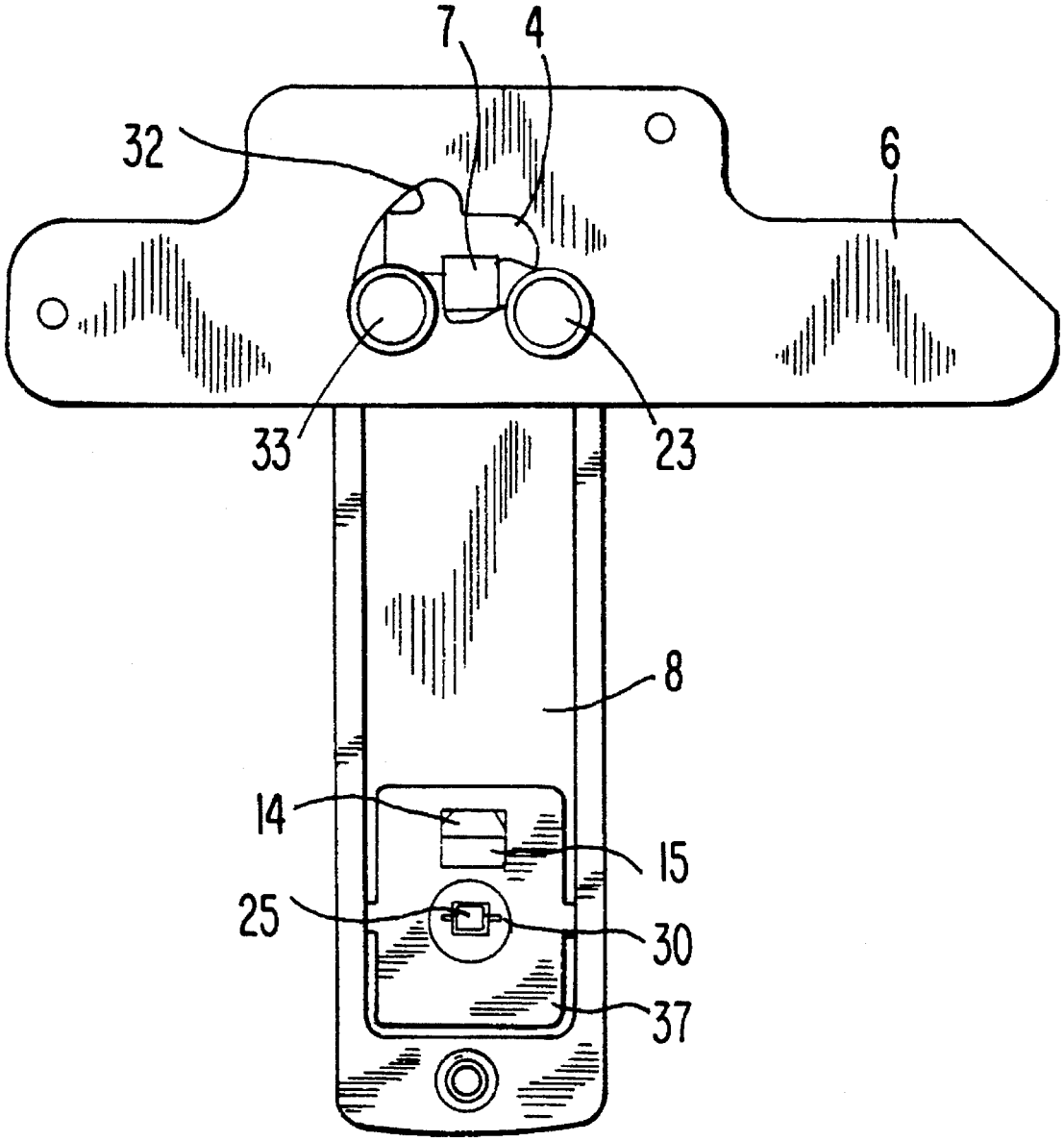
FIG. 2 is a rear view of the flush type handle assembly of the present invention shown in FIG. 1.
Figure 7:
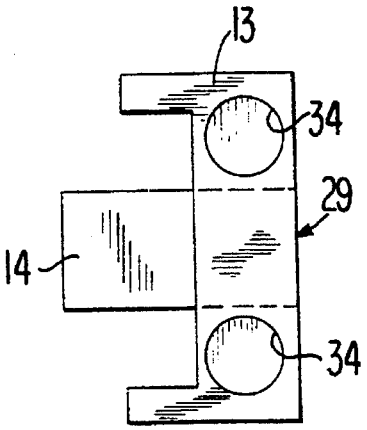
FIG. 7 is a front view of the latch element shown in FIG. 5.
Figure 8:
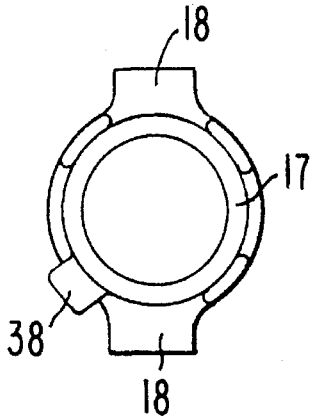
FIG. 8 is a plan view of the push button guide incorporated in the flush type handle assembly of the present invention shown in FIG. 1.
Figure 9:
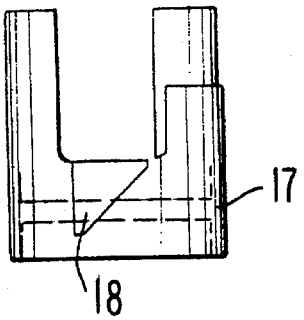
FIG. 9 is a plan view of the push button guide shown in FIG. 8.
Figure 10:
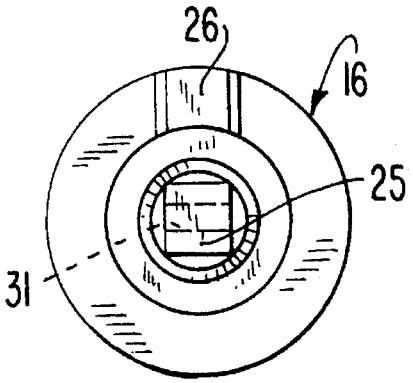
FIG. 10 is a plan view of the push button incorporated in the flush type handle assembly of the present invention shown in FIG. 1.
Figure 13:
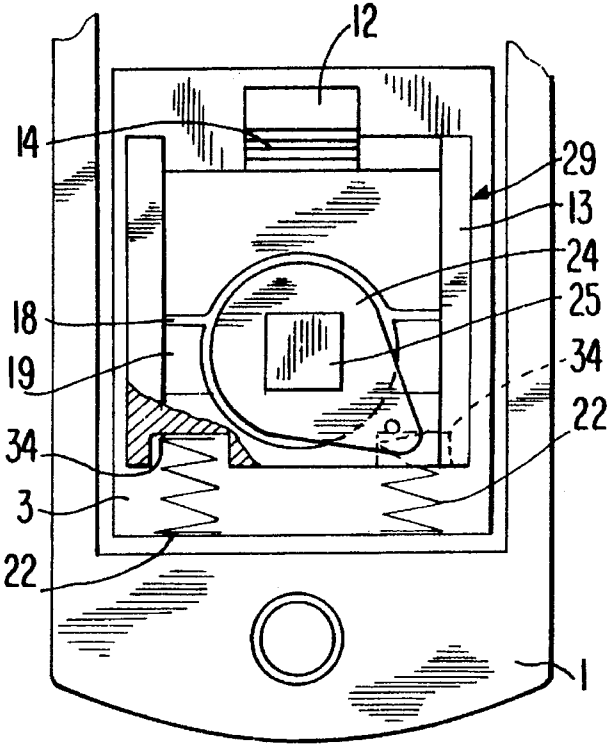
FIG. 13 is an enlarged rear view of an essential portion of the flush type handle assembly of the present invention shown in FIG. 1, illustrating the latch element and a detent plate portion thereof.
Figure 12:
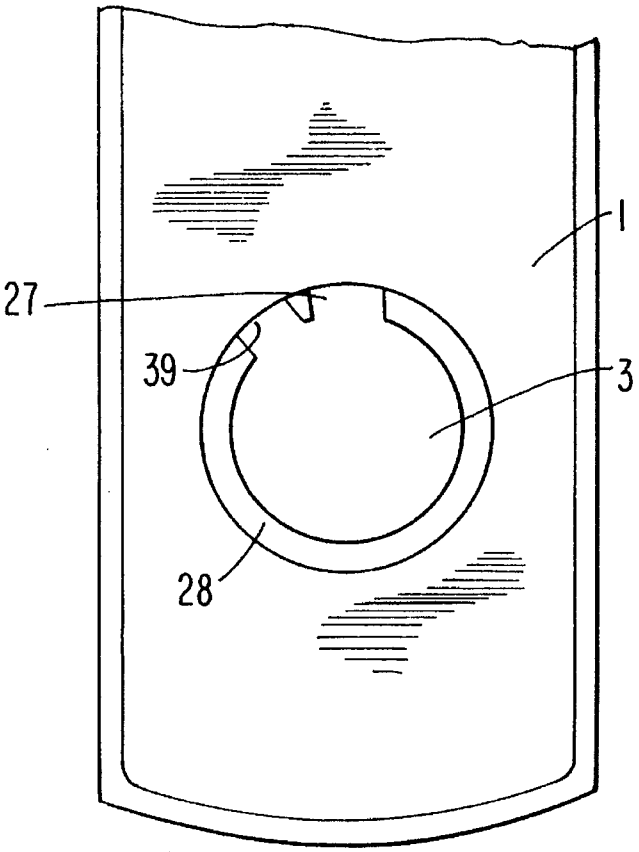
FIG. 12 is an enlarged front view of the guide hole portion of the casing of the flush type handle assembly of the present invention shown in FIG. 1.
Figure 11:
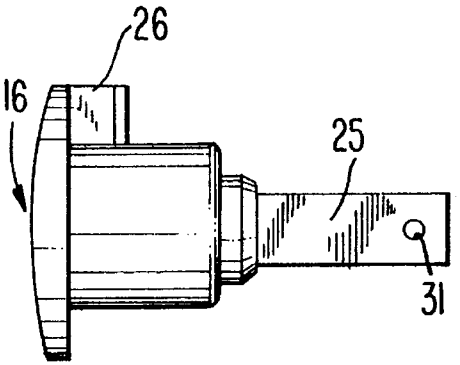
FIG. 11 is a side view of the push button shown in FIG. 8.

Hereinbelow, the present invention will be described in detail with reference to the accompanying drawings and the reference numerals and characters therein.

In a push button-operated flush type handle assembly of the present invention: a casing 1 is provided with a concave housing 2 and a guide hole 3 adjacent to the concave housing 2; and, a projectable and retractable handle body 4 is pivotally mounted in the concave housing 2 through a cross pivot 5, and swingably urged by a first spring 20 in its projecting direction.

The handle body 4 is further provided with a first operating projection 7 which projects rearward from a rear side of the handle body 4 for rotatably driving a lock plate 6. A first escape hole 9 is provided in a bottom wall 8 of the casing 1 to permit the first operating projection 7 to pass therethrough. A push button 16 is mounted in the guide hole 3 in an insertion manner. A latch element 29 fitted to the push button 16 is also mounted in the guide hole 3 in an insertion manner, and slidably urged toward the cross pivot 5 by a second spring 22.

A locking projection 12, which is engaged with and disengaged from a receiver projection 11 of the handle body 4, is provided in a front end of the latch element 29. The latch element 29 is provided with a second operating projection 14 in its rear side to have the second operating projection 14 project rearward from the rear side. A second escape hole 15 is provided in the bottom wall 8 of the casing 1 to permit the second operating projection 14 to pass therethrough. On the other hand, a first oblique cam surface 18, which abuts on a second oblique cam surface 19 of the latch element 29, is provided in the push button 16 itself or in a rear surface of a side portion of a push-button guide 17 fitted to the push button 16.

In operation, when the push button 16 is depressed from outside a door in front of the casing 1 permitting an integral depression of the push-button guide 17 with the push button, the first oblique cam surface 18 of the push button 16 pushes the second oblique cam surface 19 of the latch element 29 to move the latch element 29 downward in opposition to the action of the second spring (i.e., latch spring) 22. When the locking projection 12 of the latch element 29 is disengaged from the receiver projection 11 of the handle body 4, the handle body 4 is released and swingably driven outward under the influence of a resilient force exerted by the first spring 20, so that the lock plate 6 is rotatably moved to its unlocking position by the first operating projection 7 of the handle body 4.

When the second operating projection 14 of the latch element 29 is depressed from inside the door in the rear side of the casing 1, the locking projection 12 of the latch element 29 is disengaged from the receiver projection 11 of the handle body 4 to release the handle body 4, so that the handle body 4 is projected from the casing 1 under the influence of the resilient force of the first spring 20, whereby the operating projection 7 of the handle body 4 rotatably moves the lock plate 6 to its unlocking position.

In the embodiment of the present invention shown in the drawings, the concave housing 2 of the handle body 4 mounted in the casing 1 communicates with the guide hole 3 of the push button 16 inside the casing 1 to permit the locking projection 12 of the latch element 29 to move in and out of these portions 2, 3. The handle body 4 housed in the concave housing 2 is pivoted to the casing 1 through the cross pivot 5, which has its opposite ends mounted in opposite side walls of the casing 1. The first spring 20 is constructed of a torsion coil spring, which has one of its opposite linear ends abut on the rear surface of the handle body 4 and the other abut on the bottom wall of the casing 1.

The lock plate 6 is mounted on a rear surface of the casing 1 through a screw 23 forming a fixed pivot. On the other hand, the first operating projection 7 projecting from the rear surface of the handle body 4 is inserted into a follower hole 32 of the lock plate 6. This follower hole 32 engages with a guide screw 33 which is threadably fastened to the casing 1. A pair of the second springs or latch springs 22 are constructed of compression coil springs, for which springs 22 there are provided a pair of spring-support concave portions 34 in a base-end surface of the latch element 29. On the other hand, the receiver projection 11 is provided in a rear edge portion of a front-end concave portion 10 of the handle body 4.

A return spring 21, which is constructed of a compression coil spring, is interposed between a rear end of the push-button guide 17 and the bottom wall of the casing 1. A square shaft portion 25 of a rear end of the push button 16, which projects from a shaft hole 35 of the bottom wall of the casing 1 rearward, is provided with a receptive hole 31 for receiving a dropping-prevention spring 30 therein. On the other hand, the latch element 29 is provided with the second oblique cam surface 19 in each of opposite side portions of a front surface of its support-frame portion 13. This portion 13 is integrally formed with a base end of the locking projection 12. The corresponding first oblique cam surface 18 of the push button 16 is provided in each of opposite side portions of a rear surface of the push-button guide 17 fitted to the push button 16.

The bottom wall portion of the casing 1, in which the second escape hole 15 of the second operating projection 14 and the shaft hole 35 of the push button 16 are formed, is constructed of a rear plate 37 which is staked in the casing 1. A side convex portion 38 of the push-button guide 17 is constantly engaged with a positioning concave portion 39 of an inner peripheral surface of the guide hole 3. When the push button 16 is depressed by a predetermined depth, a side projection 26 of the push button 16 engages with a receptive groove portion 27 of an inner peripheral surface of the guide hole 3. On the other hand, when the push button 16 is rotated by a predetermined angle without being depressed to have its side convex portion or projection 26 abut on an inner peripheral shoulder surface 28 of the guide hole 3, the push button 16 is locked to inhibit a person from depressing the push button 16. A groove 36, through which a person rotatably operates the push button 16, is provided in a front-end portion of the button 16. A detent plate 24 is mounted on the square shaft portion 25 of the push button 16 to keep the button 16 in its unlocking and locking positions.

As described above, the push button-operated flush type handle assembly of the present invention having the above construction enables a person trapped inside the cabinet and the like to escape from the cabinet by himself, by depressing the second operating projection 14 to move the latch element 29 downward. Namely,, the thus moved-down latch element 29 has its locking projection 12 disengaged from the receiver projection 11 of the handle body 4 to release the handle body 4 permitting a projecting action of the handle body 4, which enables a person trapped in the cabinet to rotate the handle, body 4 permitting a rotatable movement of the lock plate 6 toward its unlocking position, so that the person trapped in the cabinet can open the door from inside the cabinet to escape therefrom easily.

Even when the push button 16 is locked to inhibit its depression, the latch element 29 can be slidably moved to its unlocking position by means of the operating projection 14 thereof without being restricted by positions of the push button 16. Consequently, a necessary safety precaution against trapped persons is devised as described in the above.

What is claimed is:

1. A push button-operated flush type handle assembly, characterized in that:

a casing (1) is provided with a concave housing (2) and a guide hole (3) adjacent to said concave housing (2);

a projectable and retractable handle body (4) pivotally mounted in said concave housing (2) through a cross pivot (5), and swingably urged by a first spring (20) in a projecting direction;

said handle body (4) being further provided with a first operating projection (7) which projects rearward from a rear side of said handle body (4) for rotatably driving a lock plate (6);

a first escape hole (9) provided in a bottom wall (8) of said casing (1) to permit said first operating projection (7) to pass therethrough;

a push button (16) mounted in said guide hole (3);

a latch element (29) fitted to said push button (16) is also mounted in said guide hole (3);

said latch element (29) being slidably urged toward said cross pivot (5) by a second spring (22);

a locking projection (12), which is engaged with and disengaged from a receiver projection (11) of said handle body (4) and is provided in a front end of said latch element (29);

said latch element (29) being provided with a second operating projection (14) in a rear side to have said second operating projection (24) project rearward from said rear side;

a second escape hole (15) provided in said bottom wall (8) of said casing (1) to permit said second operating projection (14) to pass therethrough; and a first oblique cam surface (18), which abuts on a second oblique cam surface (19) of said latch element (29), provided in said push button (16).

2. The push button-operated flush type handle assembly of claim 1, wherein said lock plate (6) is mounted on a rear surface of said casing (1) by a screw (23) forming a pivot, said first operating projection (7) is inserted through a follower hole (32) of said lock plate (6), and said follower hole (32) engages with a guide screw (33) fastened to said casing (1).

3. The push button-operated flush type handle assembly of claim 1, wherein a pair of said second spring (22) is provided in said latch element (29) and are received in base end concave portions (34) of the latch element (29).

4. The push button-operated flush type handle assembly of claim 1, wherein a return spring (21) is interposed between a rear end of said push button guide (17) and the bottom wall of said casing (1).

* * * * *